US010577896B2

(12) United States Patent
Dowsett et al.

(10) Patent No.: US 10,577,896 B2
(45) Date of Patent: Mar. 3, 2020

(54) WELL SCREEN AND METHOD OF MANUFACTURE

(71) Applicant: Completion Products Pte Ltd, Singapore (SG)

(72) Inventors: Graeme John Dowsett, Singapore (SG); Anush Rajaram, Singapore (SG); Kim Choik Tay, Singapore (SG)

(73) Assignee: Completion Products Pte Ltd, Singapore (SG)

( * ) Notice: Subject to any disclaimer, the term of this patent is extended or adjusted under 35 U.S.C. 154(b) by 36 days.

(21) Appl. No.: 14/192,328

(22) Filed: Feb. 27, 2014

(65) Prior Publication Data

US 2015/0240606 A1 Aug. 27, 2015

(51) Int. Cl.
*E21B 43/08* (2006.01)

(52) U.S. Cl.
CPC ..... *E21B 43/084* (2013.01); *E21B 43/08* (2013.01)

(58) Field of Classification Search
None
See application file for complete search history.

(56) References Cited

U.S. PATENT DOCUMENTS

| | | | | |
|---|---|---|---|---|
| 2,143,072 | A * | 1/1939 | Johnson | E21B 43/086 138/154 |
| 7,287,684 | B2 * | 10/2007 | Blackburne, Jr. | B01D 29/111 166/231 |
| 2002/0070031 | A1 * | 6/2002 | Voll | B01D 29/111 166/380 |
| 2002/0084070 | A1 * | 7/2002 | Voll | B01D 29/111 166/206 |
| 2004/0004110 | A1 * | 1/2004 | Blackburne, Jr. | B01D 29/111 228/130 |
| 2006/0137883 | A1 * | 6/2006 | Kluger | E21B 43/084 166/380 |
| 2007/0256834 | A1 * | 11/2007 | Hopkins | E21B 43/082 166/278 |
| 2009/0184101 | A1 * | 7/2009 | Hoffman | F23Q 7/001 219/270 |
| 2010/0319914 | A1 * | 12/2010 | Dowsett | E21B 43/084 166/276 |
| 2016/0024895 | A1 * | 1/2016 | Russell | E21B 43/084 166/230 |

* cited by examiner

*Primary Examiner* — William D Hutton, Jr.
*Assistant Examiner* — Steven A MacDonald

(57) ABSTRACT

A method of construction of a well screen comprising the steps of providing a base pipe: spiral winding an inner drainage layer around the base pipe; spiral winding a filter layer around the inner drainage layer, then; spiral winding an outer drainage layer around the filter layer. Also disclosed is a well screen, comprising: a base pipe; a spiral-wound inner drainage layer disposed around the base pipe; a spiral-wound filter layer disposed around the inner drainage layer; and a spiral-wound outer drainage layer disposed around the filter layer.

9 Claims, 2 Drawing Sheets

WELL SCREEN AND METHOD OF MANUFACTURE

FIELD OF THE INVENTION

The invention relates to apparatus used in wells for the filtering of fluids, such as wells used in the petrochemical industry. In particular, the invention is directed to down hole pipes, well screens and the method of manufacture of such equipment.

BACKGROUND

The extraction of fluids such as oil, gas or water from subterranean wells involves introducing a transportation pipe into the ground. The fluid is forced to the surface of the earth through the pipe by natural pressure in the well, a pump above ground, or displacing the fluid with another fluid, such as using water to displace oil. Such a process involves a flow of highly pressurised fluid into the pipe which inevitably carries along with it detritus in the form of sand, stones and other particles, which abrades and erodes the welling machinery. Therefore, it is a common practice to provide a filter assembly, known as a well screen, at the submerged opening of the transportation pipe to separate the fluid from the solids. The environment within the well is such that very high hydraulic pressure is applied to the well screen. Further, wells can be unstable, and so the well screen must withstand localised external loads from the partial collapse of the well wall.

In the construction of such well screens, it is common to have a layer of filter media to act as a filter against the introduction of detritus into the pipe. Typically the layer of filter material is applied to the base pipe as a sheet which wraps around the base pipe and seam welded. Such seam welding, however, can damage the filter media and so provide an area of weakness or localised failure proximate to the seam during adverse conditions.

Damage or misalignment to the filter layer can create an area whereby an inflow of detritus into the pipe can occur. Whilst the damage may be in a localised portion of the filter and so affecting only a small area of the pipe, because of the inflow of the detritus, the entire intake of the fluid may be contaminated. Accordingly, increased cost results, affecting the viability of the pipe as a whole. It will be appreciated that for seam welding, extended portions of the pipe may be affected or affected at multiple areas.

It follows that if the filter media is damaged and the inflow of detritus into the pipe is affecting performance, then a repair of the pipe will require the full extraction from the well leading to significant downtime. However, in most circumstances, a repair may not be possible as the filter media is typically encapsulated within an external shroud. If the shroud is not easily removable (and typically the shrouds of prior art well screens are not), then non destructive testing of the pipe will be required to determine the location of any damaged portions of the filter media. In many circumstances it may be easier to merely replace the well screen leading to a significant cost increase to the project.

Further, a failure in the filter media may lead to a significant drop in the pressure differential at that point. That is, the pressure drop associated with the filter media (if damaged), may be reduced to almost zero. Further, in the case of gaps in the filter media due to damage, the peripheral edges of this damaged zone may represent a stress concentration in the well screen. Such a stress concentration, if undetected may propagate the damage, increasing the potential for an influx of detritus as well as increasing the possibility of catastrophic collapse of the well screen and so increasing the overall cost of extraction of the failed well screen.

SUMMARY OF INVENTION

In a first aspect the invention provides a method of construction of a well screen comprising the steps of: providing a base pipe; spiral winding an inner drainage layer around the base pipe; spiral winding a filter layer around the inner drainage layer, then; spiral winding an outer drainage layer around the filter layer.

In a second aspect, the invention provides a well screen, comprising: a base pipe; a spiral-wound inner drainage layer disposed around the base pipe; a spiral-wound filter layer disposed around the inner drainage layer; and a spiral-wound outer drainage layer disposed around the filter layer.

By spiral winding the filter media rather than wrapping a single sheet, the chances of damaging the filter media are reduced, due to the lack of seam welding that is required to maintain the sheet of filter media. Accordingly, reducing the opportunity for damage may lead to an improved well screen as compared to the prior art.

It will be noted that the spiral winding of the various layers is sequential, and not an instantaneous application of adjacent layers, as may be the case of spiral winding several layers as one. The process according to embodiments of the present invention may include a base pipe receiving several layers simultaneously along its length, however, at any given point only one layer will be applied at a time.

In one embodiment, the invention provides for a designated inspection step for the filter media layer. Thus, the sequential nature of the manufacturing method may permit inspection to ensure the veracity of the filter layer. Such inspection may be manually by an operator, or alternatively, a camera may be used for the vision. The camera may be positioned proximate to the point of winding onto the pipe.

On spiral winding the various layers, the layers may be applied in strips of known width (w). The strips may be applied perpendicularly to the pipe. Alternatively, the strips may be pre-positioned at the winding angle ($\phi$), being the natural angle for which the strips may wrap around the pipe without imparting internal stresses to the layer, where:

$\phi=\sin^{-1}(w/\pi D)$ where: $D$ is the pitch circle diameter (PCD) of the layer It follows that, for different materials, the width of said materials may be different. Hence, the winding angle may vary also. In cases where several layers are applied at the same time, the winding angle will need to be calculated for the different PCD. Further the strips of material for the layers will need to be trimmed so as to match this angle. If not, differential stresses may be imparted between the layers, as each layer seeks to re-distribute the internal stresses of an imprecise winding angle. Sequential winding according to embodiments of the present invention avoids this issue.

By providing spirally wound layers, a well screen according to embodiments of the present invention may have a reduced outside diameter compared to the prior art. This may lead to an increased tolerance between the well and well screen, which may assist in easier placement, extraction and optimise drainage conditions. Further, the spiral winding process imparts a radial force inwards, to close gaps between layers. In a further embodiment the shroud is also reduced in size, which may add to this effect. By having a well screen with reduced or eliminated gaps, the assembly of layers may be strengthened through a more compact construction. Further, in one embodiment where the filter layer is not welded, the net radial force, and reduced or eliminated gaps ensure the filter layer remains integral, as there is no tolerance by which the filter could slip into misalignment.

In a further embodiment, the spiral winding of the filter layer may allow the use of unsintered filter mesh, providing a cheaper alternative to sintered filters.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION OF DRAWINGS

Figures 1A, 1B:
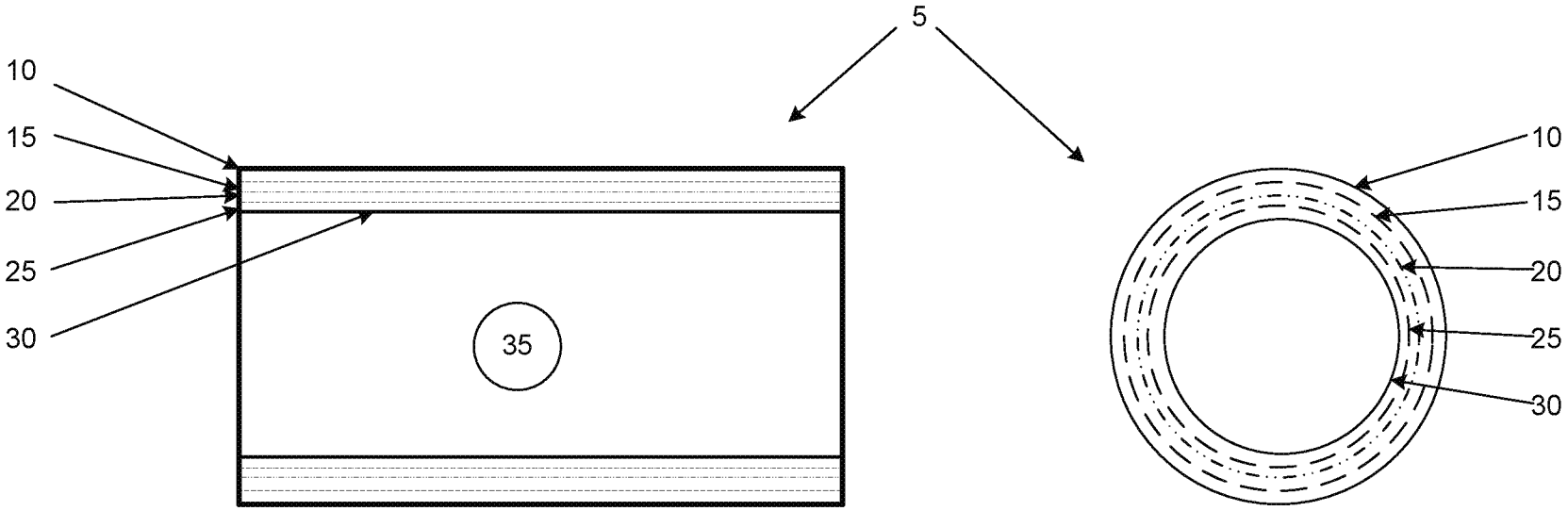
FIGS. 1A and 1B are various cross-sectional views of a well screen manufactured according to one embodiment of the present invention.

FIGS. 1A and 1B show a side and end cross-sectional views of a well screen 5 used with a pipe to remove fluid from a well.

The well screen 5 is characterised by a base pipe 30 which acts to receive the fluid through apertures 32 in the pipe wall transport the fluid from the well to the surface. It is intended that the bore 35 of the pipe minimise from detritus flowing with the extracted fluid.

Applied to the base pipe is a spirally wound inner drainage layer 25 which may be a welded mesh having a welded spiral seam. The inner drainage layer may be wound onto the base pipe as a 200 mm strip of stainless steel mesh, for instance 304SS, made from 0.76 mm wire, with the finished layer possibly adding 1.3 mm to the thickness of the well screen.

Around the inner drainage layer 25 is a filter layer 20 which in this case is a spirally wound mesh. Being spirally wound, the filter layer 20 may be an unsintered filter material, offering a lower cost option than sintered materials, which are also less capable of being spirally wound. In the case of a mesh, the filter material may be in the range of 115 to 250 μm, formed in a 2, 3 or 4 layer weave, such as a plain Dutch weave or Square weave. In this embodiment, the filter layer is not welded, but is wound with an overlap to ensure edge effects for the filter are avoided. In certain embodiments, successive spirals of the filter layer have edges which overlap by an amount in the range 2.5 cm (1 in) to 5 cm (2 in). This amount of overlap may assist to prevent loss of sand control in the event that the mesh of the filter layer expands circumferentially.

In certain embodiments, the filter layer 20, prior to being spiral wound on the inner drainage layer 25, may be subjected to solution annealing. The filter layer 20 may be placed in a vacuum furnace and soaked for a predetermined period, preferably in the range 0.5 to 2 hours, at a temperature of 1050 degrees C. The solution annealing process increases the mechanical strength of the filter mesh.

Over the filter layer 20 is an outer drainage layer 15, also spirally wound, and formed from a mesh of up to 4 mm rod and 2 mm wire, to form a rigid skeleton effect. The outer drainage layer may for the major structural component of the well screen, and thus forming an endoskeleton structure. An outer shroud 10 is then placed over the outer drainage layer 15.

In one embodiment the outer shroud 10 may be swaged as to compress the shroud into the drainage layer to prevent the formation of gaps in the overall construction. The swaged shroud may provide a compressive hoop/radial stress to the underlying layers 15, 20, 25 of the well screen 5 ensuring full contact of adjacent layers and so providing support against buckling of any subsequent layer when external hydraulic pressures are applied. The shroud 10 may be a perforated steel sheet, having an array of inflow apertures 14 placed along its length and circumference. The shroud 10 may be wrapped around the outer drainage layer 15, or as shown in FIG. 2, spirally wound.

In the case of a sheet or sleeve placed over the outer drainage layer, the shroud may be swaged or roll formed so as to deform the shroud, reducing in size. In so doing the shroud may apply a further radial force reducing gaps within the well screen. In the case of a spiral wound shroud, the shroud may or may not be re-sized as previously described, subject to the application.

Figure 2:
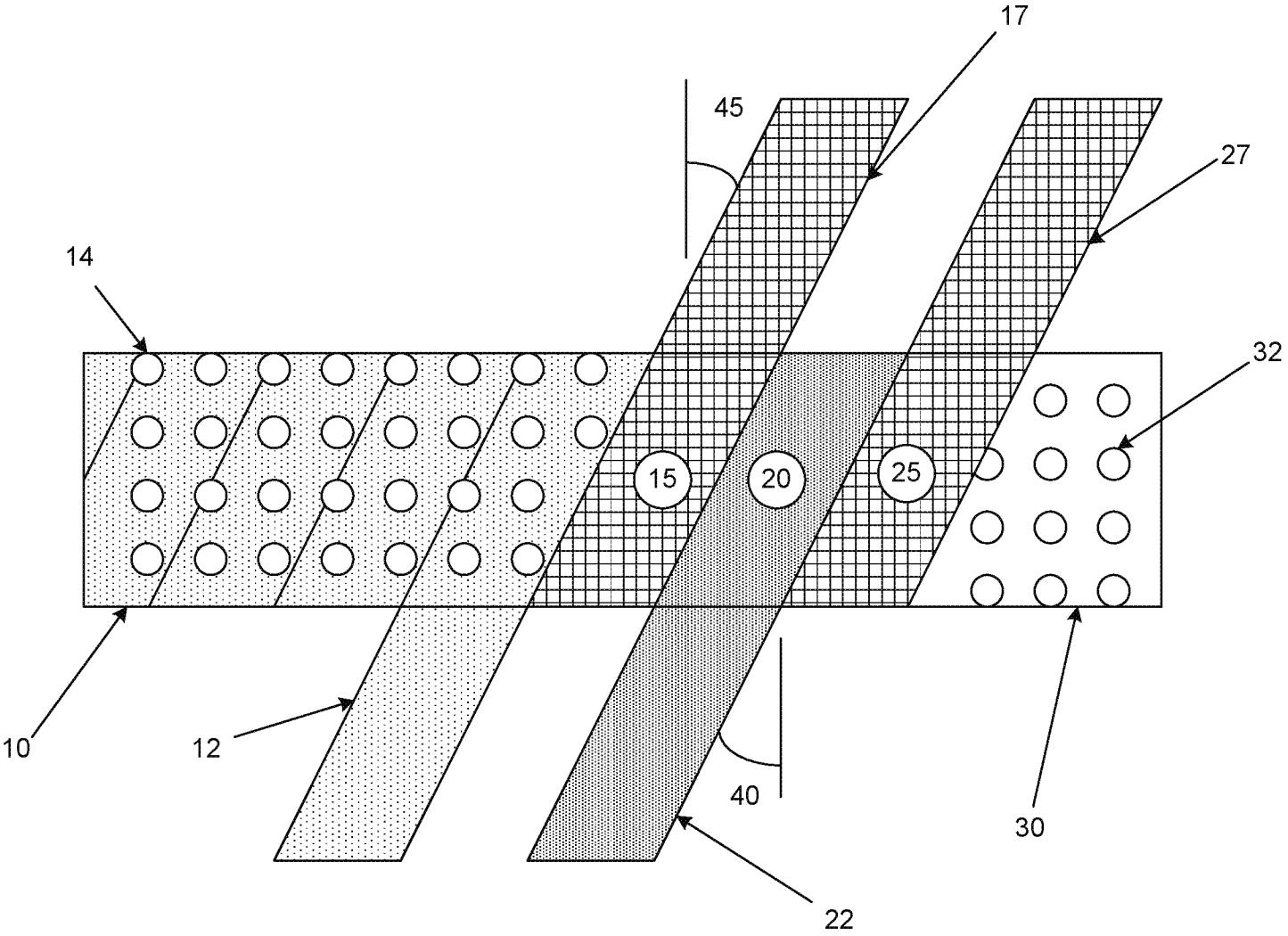
FIG. 2 is a plan view of the well screen according to one embodiment of the present invention during the manufacturing process.

As shown in FIG. 2, the various layers may be spirally wound onto the pipe in sequential form. Whilst the embodiment of FIG. 2 shows a substantially simultaneous winding process, in certain embodiments each layer is completed before commencing the next layer, and so acting as a batch process, rather than a continuous process of FIG. 2.

In the case of a batch process, the winding angle 40, 45 may vary from layer to layer, allowing strips of different thickness to be wound. For a continuous process, it may be necessary to have a similar winding angle 40, 45, subject to the rate of winding, and the variation in the winding angles. From FIG. 2 it will be clear that if the winding angle 40 of the filter 20 is different from the winding angle 45 of the outer drainage layer 15, then the respective entries 17, 22 of the filter layer and outer drainage layer may also need to vary.

The invention claimed is:

1. A method of construction of a well screen comprising the steps of:

providing a base pipe;

spiral winding a welded mesh directly on the base pipe without spaces or offsets to form an inner drainage layer defined by the welded mesh and the openings in the welded mesh which eliminates gaps between the inner drainage layer and the base pipe layer around the entirety of the base pipe while draining fluid through the openings of the welded mesh into the base pipe;

spiral winding a filter layer around the inner drainage layer which eliminates gaps between the filter layer and the inner drainage layer, then;

spiral winding an outer drainage layer around the filter layer which eliminates gaps between the outer drainage layer and the filter layer; and applying a shroud as an outer most layer over the outer drainage layer, wherein the applying step includes spiral winding the shroud, further including the step of reducing the size of the shroud after the applying step, wherein the reducing step includes roll forming the shroud so as to apply a radial force to the shroud to deform it about the outer drainage layer.

2. The method according to claim 1, further including the step of inspecting the filter layer between the spiral winding of the filter layer and the spiral winding of the outer drainage layer.

3. The method according to claim 1, wherein the spiral winding of the filter layer includes aligning adjacent edges of the filter so as to overlap said edges.

4. The method according to claim 1, further comprising the step of annealing the filter layer prior to spiral winding of said layer.

5. The method according to claim 1, wherein said outer drainage layer is arranged to act as an endo-skeletal layer providing support to the well screen.

6. A well screen manufactured according to the method of claim 1.

7. A well screen, comprising:

a base pipe;

a spiral-wound inner drainage layer, being a welded mesh, disposed around the base pipe and defined by the welded mesh and the openings in the welded mesh which eliminates gaps between the inner drainage layer and the base pipe layer around the entirety of the base pipe while draining fluid through the openings of the welded mesh into the base pipe;

a spiral-wound filter layer disposed around the inner drainage layer which eliminates gaps between the filter layer and the inner drainage layer;

a spiral-wound outer drainage layer disposed around the filter layer which eliminates gaps between the outer drainage layer and the filter layer, wherein the base pipe and the inner drainage layer are contiguous, the inner drainage layer and the filter layer are contiguous, and the filter layer and the outer drainage layer are contiguous; and a shroud disposed as an outer most layer over the outer drainage layer, wherein the shroud comprises a layer of spiral-wound material, wherein the shroud is roll formed by applying a radial force to both deform and reduce the size of the shroud about the outer drainage layer.

8. A well screen according to claim 7, wherein the filter layer comprises a plurality of spirals, and wherein successive spirals have edges which are at least partially overlapping.

9. The well screen according to claim 7, wherein the filter layer comprises unsintered filter material.

* * * * *